US009568220B2

(12) United States Patent
Yazdani et al.

(10) Patent No.: US 9,568,220 B2
(45) Date of Patent: Feb. 14, 2017

(54) EJECTOR MIXER

(75) Inventors: Miad Yazdani, Oak Park, IL (US); Abbas A. Alahyari, Manchester, CT (US); Thomas D. Radcliff, Vernon, CT (US); Parmesh Verma, Manchester, CT (US)

(73) Assignee: Carrier Corporation, Jupiter, FL (US)

( * ) Notice: Subject to any disclaimer, the term of this patent is extended or adjusted under 35 U.S.C. 154(b) by 209 days.

(21) Appl. No.: 14/005,419

(22) PCT Filed: Jun. 21, 2012

(86) PCT No.: PCT/US2012/043453
§ 371 (c)(1),
(2), (4) Date: Sep. 16, 2013

(87) PCT Pub. No.: WO2013/003179
PCT Pub. Date: Jan. 3, 2013

(65) Prior Publication Data

US 2014/0109604 A1 Apr. 24, 2014

Related U.S. Application Data

(60) Provisional application No. 61/501,448, filed on Jun. 27, 2011.

(51) Int. Cl.
*F25B 1/06* (2006.01)
*F25B 1/08* (2006.01)
(Continued)

(52) U.S. Cl.
CPC ..... *F25B 1/08* (2013.01); *B01F 5/0415* (2013.01); *F25B 9/008* (2013.01); *F25B 41/00* (2013.01);
(Continued)

(58) Field of Classification Search
CPC ..... F25B 1/08; F25B 9/008; F25B 41/00; F25B 2500/01; F25B 2309/06; F25B 2341/0012; B01F 5/0415
(Continued)

(56) References Cited

U.S. PATENT DOCUMENTS 3,838,002 A * 9/1974 Gluntz et al. ..... F04F 5/10 261/DIG. 75
4,301,662 A 11/1981 Whitnah
(Continued)

FOREIGN PATENT DOCUMENTS

CN 1332344 A 1/2002
CN 1590926 A 3/2005
(Continued)

OTHER PUBLICATIONS

Chinese Office Action for Chinese Patent Application No. 201280031987.2, dated Aug. 25, 2015.
(Continued)

*Primary Examiner* — Len Tran
*Assistant Examiner* — Ana Vazquez
(74) *Attorney, Agent, or Firm* — Bachman & LaPointe, P.C.

(57) ABSTRACT

An ejector mixer has a convergent section and a downstream divergent section downstream of the convergent section. The downstream divergent section has a divergence half angle of 0.1-2.0° over a first span of at least 3.0 times a minimum diameter of the mixer.

18 Claims, 3 Drawing Sheets

(51) Int. Cl.

| | |
|---|---|
| ***F25B 9/00*** | (2006.01) |
| ***F25B 41/00*** | (2006.01) |
| ***B01F 5/04*** | (2006.01) |

(52) U.S. Cl.
CPC .... *F25B 2309/06* (2013.01); *F25B 2341/0012* (2013.01); *F25B 2500/01* (2013.01)

(58) Field of Classification Search
USPC ..... 62/500
See application file for complete search history.

(56) References Cited

U.S. PATENT DOCUMENTS

| | | | |
|---|---|---|---|
| 5,230,656 | A | 7/1993 | Paterson et al. |
| 5,343,711 | A | 9/1994 | Kornhauser et al. |
| 6,334,758 | B1 | 1/2002 | Popov |
| 6,742,356 | B2 | 6/2004 | Saito et al. |
| 6,782,713 | B2 | 8/2004 | Takeuchi et al. |
| 6,941,768 | B2 | 9/2005 | Ikegami et al. |
| 7,497,666 | B2 | 3/2009 | Garris, Jr. |
| 2005/0044881 | A1 | 3/2005 | Ogata et al. |
| 2010/0313582 | A1 | 12/2010 | Oh et al. |
| 2012/0034106 | A1 | 2/2012 | Lecoffre et al. |

FOREIGN PATENT DOCUMENTS

| | | | |
|---|---|---|---|
| CN | 101532760 | A | 9/2009 |
| EP | 1160522 | A1 | 12/2001 |
| FR | 1160155 | A | 7/1958 |
| WO | 2010/116076 | A1 | 10/2010 |

OTHER PUBLICATIONS

Chinese Office Action for Chinese Patent Application No. 201280031987.2, dated Jan. 30, 2015.

Praitoon Chaiwongsa et al., Effect of Throat Diameters of the Ejector on the Performance of the Refrigeration Cycle Using a Two-Phase Ejector as an Expansion Device, International Journal of Refrigeration, May 1, 2007, pp. 601-608, vol. 30, No. 4.

International Search Report and Written Opinion for PCT/US2012/043453, dated Aug. 9, 2012.

Chinese Office Action for Chinese Patent Application No. 201280031987.2, dated Dec. 21, 2015.

* cited by examiner

EJECTOR MIXER

CROSS-REFERENCE TO RELATED APPLICATION

Benefit is claimed of U.S. Patent Application Ser. No. 61/501,448, filed Jun. 27, 2011, and entitled "Ejector Mixer", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62. An expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet (exit) 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths extend from the primary inlet and secondary inlet to the outlet, merging at the exit. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

SUMMARY

One aspect of the disclosure involves an ejector having a primary inlet, a secondary inlet, and an outlet. A primary flowpath extends from the primary inlet to the outlet. A secondary flowpath extends from the secondary inlet to the outlet. A mixer convergent section is downstream of the secondary inlet. A motive nozzle surrounds the primary flowpath upstream of a junction with the secondary flowpath. The motive nozzle has an exit. The mixer has a downstream divergent section downstream of the convergent section and having a divergence half angle of 0.1-2.0° over a first span of at least 3.0 times a minimum diameter of the mixer.

In various implementations, there may be essentially no normal mixture straight portion (e.g., no straight portion of length more than 5.0 times the minimum diameter of the mixer, more narrowly, no more than 2.0 times). There may be a diffuser downstream of the mixer (e.g., having a divergence half angle of greater than 2.5° over a span of at least 3.0 times the minimum diameter of the mixer. A needle may be mounted for reciprocal movement along the primary flowpath between a first position and a second position. A needle actuator may be coupled to the needle to drive the movement of the needle relative to the motive nozzle.

Other aspects of the disclosure involve a refrigeration system having a compressor, a heat rejection heat exchanger coupled to the compressor to receive refrigerant compressed by the compressor, a heat absorption heat exchanger, a separator, and such an ejector. An inlet of the separator may be coupled to the outlet of the ejector to receive refrigerant from the ejector.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
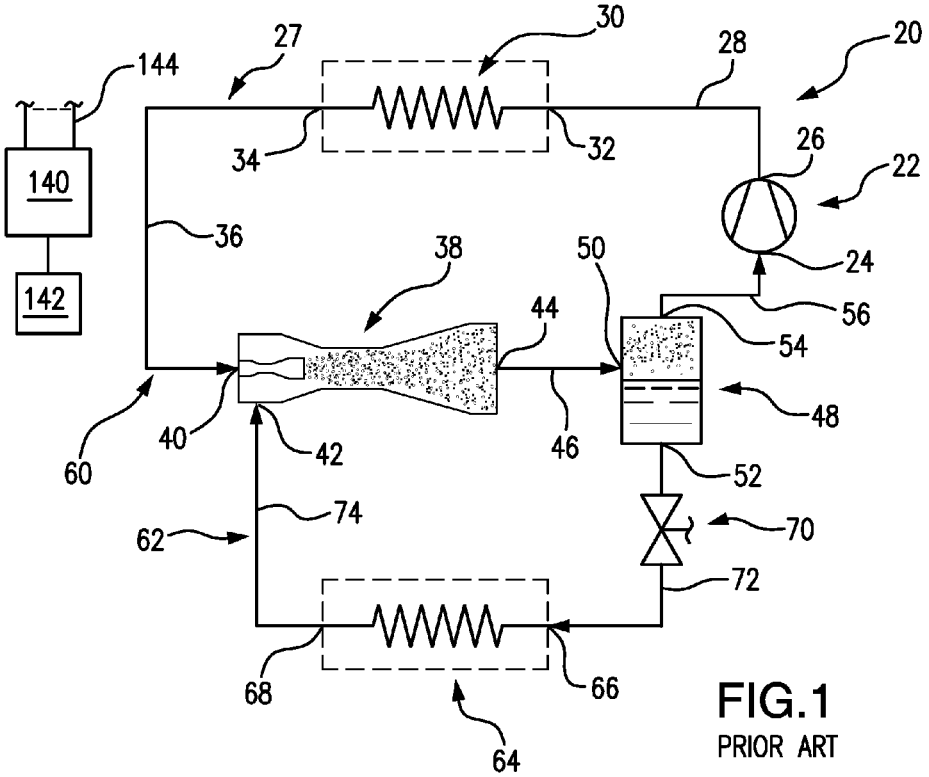
FIG.1 PRIOR ART
FIG. 1 is a schematic view of a prior art ejector refrigeration system.
Figure 2:
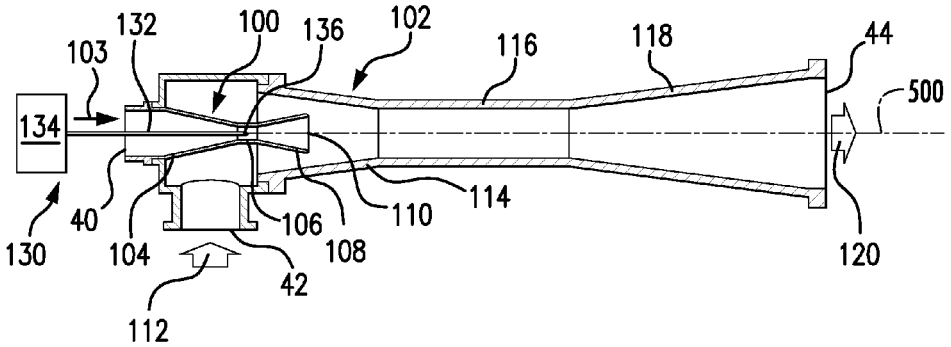
FIG. 2 PRIOR ART
FIG. 2 is an axial sectional view of a prior art ejector.
Figure 3:
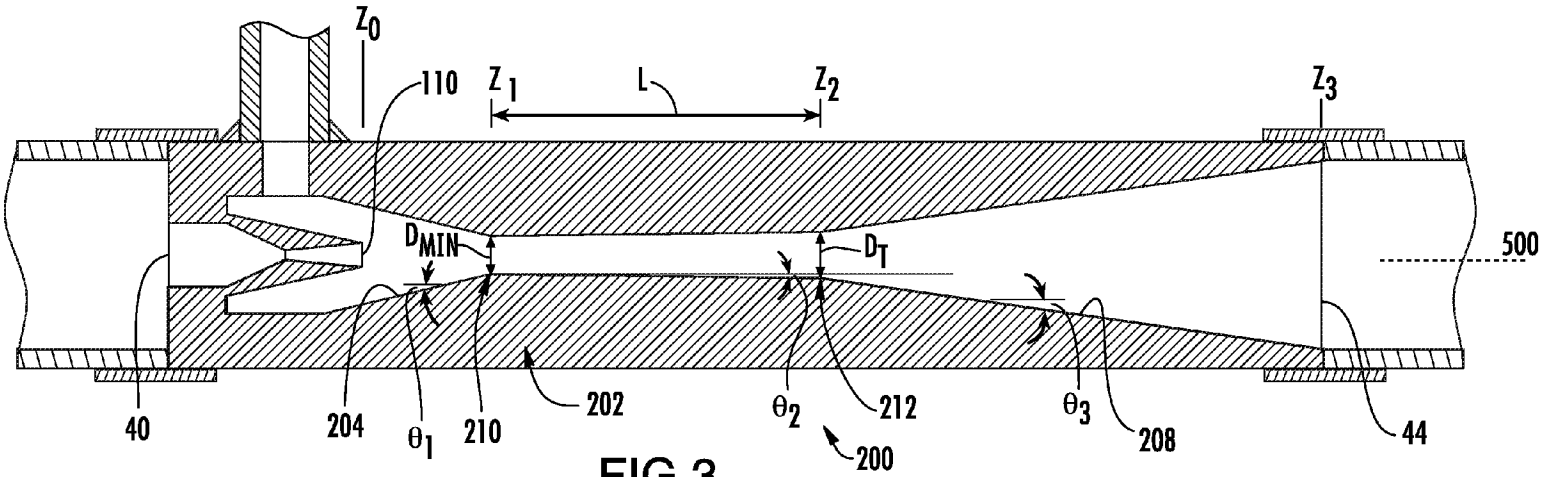
FIG. 3 is a partially schematic axial sectional view of a first ejector.

FIG. 3 shows an ejector 200. The ejector 200 may be formed as a modification of the ejector 38 and may be used in vapor compression systems (e.g., FIG. 1) where conventional ejectors are presently used or may be used in the future. An exemplary ejector is a two-phase ejector used with $CO_2$ refrigerant (e.g., at least 50% $CO_2$ by weight). To differentiate from the corresponding portions of the ejector 38, the ejector 200 has a mixer 202 having a convergent section 204 in place of the convergent section 114 and a slightly divergent section 206 in place of the mixing section 116 (discussed further below). The divergent diffuser 208 replaces the diffuser 118. As is discussed below, use of a slightly divergent section 206 is believed to limit sensitivity to off-design operation. For example, the ejectors may be optimized for performance at a given operating condition. Their efficiency will drop with departures from the design condition. Relative to a straight mixer, the slightly divergent section 206 reduces the efficiency loss for a given departure from design conditions.

FIG. 3 further shows a transition location 210 between the convergent section 204 and the section 206 and a transition location 212 between the section 206 and the diffuser 208. The mixer has a length L between these locations. The section 204 has a convergence half angle $\theta_1$. The slightly divergent section 206 has a divergence half angle $\theta_2$. The diffuser 208 has a divergence half angle $\theta_3$. In the FIG. 3 implementation, each of these half angles is essentially constant. Accordingly, in the exemplary FIG. 3 embodiment, a minimum cross-sectional area of the mixing section is found at the location 210 and has a diameter shown as $D_{MIN}$. A diameter at the location 212 is shown as $D_T$. As is discussed further below, by replacing the baseline straight mixing section 116 with the slightly divergent section 206 (e.g., less divergent than a conventional diffuser) performance sensitivity to the flow rate may be reduced. Whereas exemplary prior art and present diffuser half angles $\theta_3$ are in the vicinity of 3° or greater (e.g., at least >2.0°, more narrowly, at least >2.5° or at least >3.0°), exemplary mixing section divergence half angles are smaller than 3° (e.g., 0.1-2.0°, more narrowly, 0.5-1.5° or 0.8-1.0°). Such a mixing section angle may exist over a longitudinal span similar to the length of an existing mixer straight section (e.g., at least 3.0 times $D_{MIN}$ or an exemplary 3.0-6.0$D_{MIN}$). Exemplary diffuser length may also be greater than 3.0 times $D_{MIN}$.

This exemplary configuration may be distinguished from a hypothetical configuration that has a conventional straight mixer and a shallow diffuser in several ways. First, there is the presence of the steeper diffuser. Second, there may be the absence of any straight mixer. For example, the exemplary mixer would lack any straight or nearly straight portion (e.g., less than 0.1° half angle) over a longitudinal span of more than 5.0 times a minimum diameter of the mixer (more narrowly, 3.0 times or 2.0 times).

The pressure recovery performance of a typical ejector depends greatly on the mixer diameter. For a given operating condition (i.e. motive and suction mass flows) there exists an optimum mixer entrance diameter. A mixer diameter smaller than the optimum value results in the acceleration of the flow within the mixer which is followed by a lossy shock through the diffuser resulting in a poor pressure-rise performance. On the other hand, if the mixer is too big for the flow-rate, the entrainment of the suction flow at the entrance would be suppressed, leading to a drop in the performance.

Figure 4:
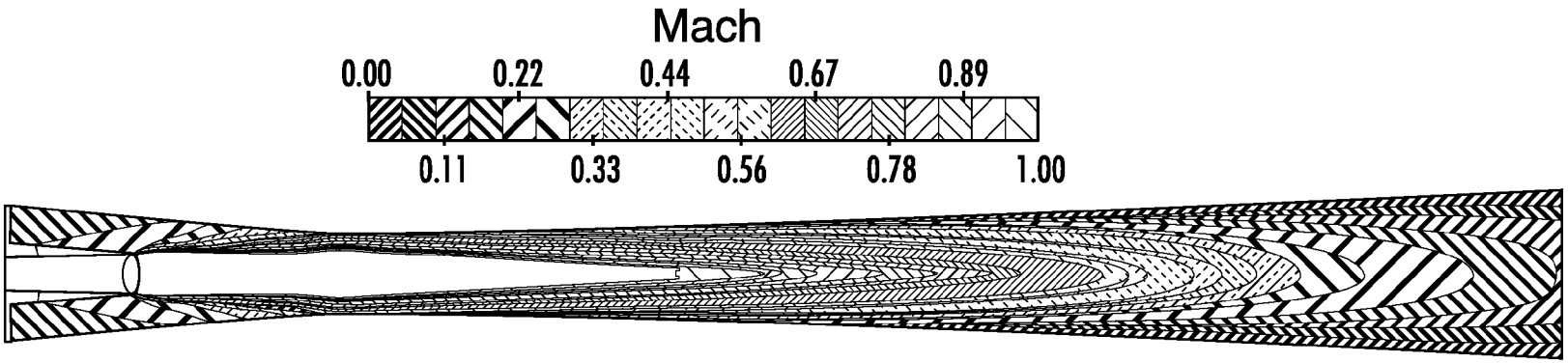
FIG. 4 is a CFD simulation of the ejector of FIG. 3.
Figure 5:
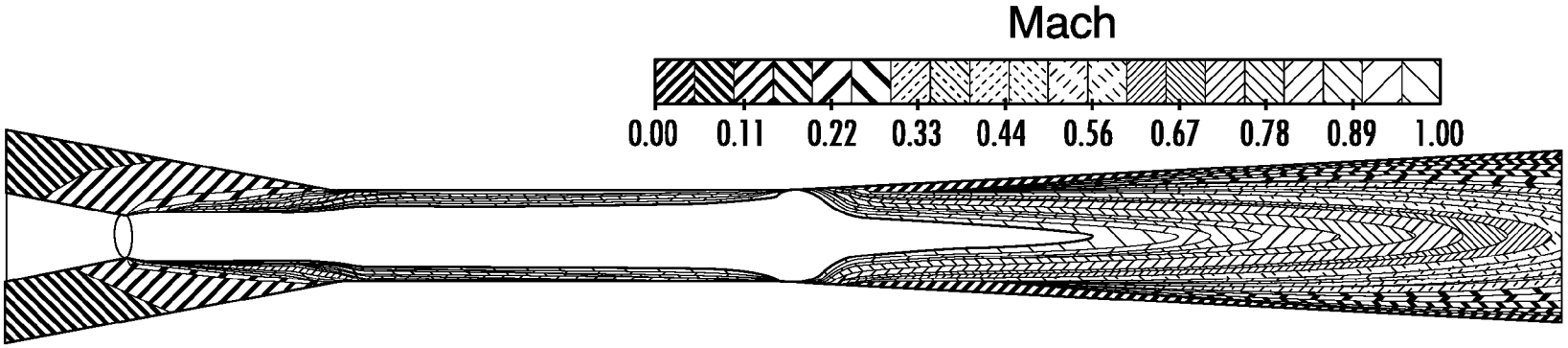
FIG.5 (Prior Art)
FIG. 5 is a CFD simulation of a prior art ejector.

FIG. 4 shows a flow through an ejector having a diverging mixer whereas FIG. 5 shows a baseline ejector having a conventional/straight mixer. In the FIG. 5 baseline: L/D=4.4 optimized for a given condition. FIG. 5 shows a flow rate slightly greater than the design value. The flow shocks to subsonic upon entering the diffuser, creating losses.

In FIG. 4, the mixer length and the minimum diameter are preserved from the baseline: $L/D_{MIN}$~4.4 and $L/D_T$~3.9. The flow decelerates in the mixer and enters the diffuser without shock.

If, however, flow rate drops below the design point, the diverging mixer will have slightly worse (more lossy) performance than the straight mixer. However, it will be worse by much less than its high flow performance is better. Thus, integrated over time, the performance of the diverging mixer will be more efficient.

Thus, in the divergent mixer, the small entrance diameter reduces the deterioration of suction entrainment at low flow rates while the divergence suppresses the flow acceleration inside the mixer for high flow rate operating conditions.

In one basic implementation, the ejector may be implemented from a conventional baseline ejector (or configuration thereof) replacing the straight mixing portion with the slightly divergent portion. For example, $D_{MIN}$ may initially be chosen as the diameter of the baseline straight mixing portion. $D_T$ will be slightly greater based upon the chosen angle $\theta_2$. The diffuser divergence angle may be preserved from the baseline. Further experimental variations may refine such ejector or configuration. For example, it has been determined that $D_{MIN}$ may be modified to be slightly less than the diameter of the baseline straight mixing portion. For example, it may be 95-100% of the baseline diameter (more narrowly, 98-99%). In distinction, $D_T$ may be slightly greater than the baseline diameter (e.g., 101-110%, more narrowly, 102-104%).

Alternatively, or additionally, a computational fluid dynamics (CFD) program may be used to model ejector performance while the various parameters are varied. For example, as discussed above, FIG. 4 shows an ejector having such a slight divergence in the mixing section 206. By way of contrast, FIG. 5 shows a similar plot for a baseline ejector. The simulated conditions involve a slight off-design operation. In baseline nominal operating conditions, the efficiencies of the prior art and FIG. 3 ejectors are both 48%. With an off-design condition of slightly higher flow, the baseline prior art ejector drops to 39% estimated efficiency whereas the ejector of FIG. 3 retains 44% efficiency.

Figure 6:
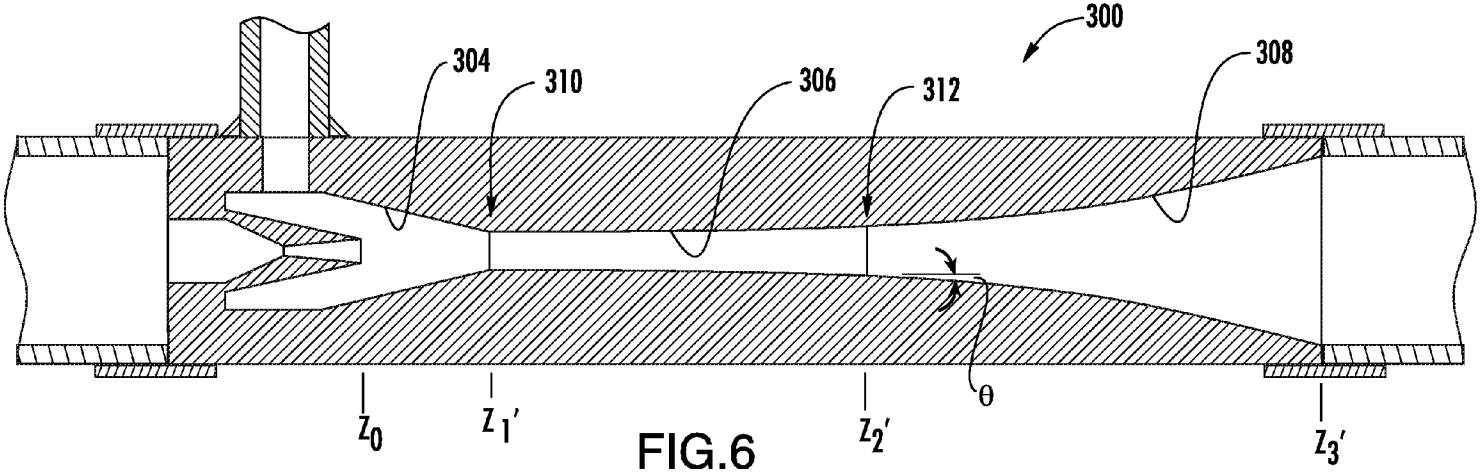
FIG. 6 is a schematic axial sectional view of a second ejector.

As an alternative variation, FIG. 6 shows an ejector 300 having a continuously curving longitudinal profile downstream of the minimum diameter location 310. To conveniently reference the longitudinal/axial positions of various locations to compare with the FIG. 3 embodiment, one possible reference is to use the motive nozzle exit as the origin of a Z axis pointing centrally downstream. Thus, this arbitrarily defines $Z_0 \equiv 0$. A location of the minimum mixer cross-sectional area (or the beginning of any straight zone at said minimum cross-sectional area) has a position $Z_1$. In the exemplary FIG. 3 embodiment, this is also the beginning of the mixer divergent portion. In the exemplary embodiment, a location of the junction between the mixer and diffuser is at a position $Z_2$. The location at the downstream end of the diffuser (where it stops diverging) is $Z_3$. In the exemplary implementation, upstream of the location 310, the ejector is otherwise the same as the ejector 200 and, therefore, other than identifying the convergent section 304 instead of 204 other portions are not distinctly numbered. The exemplary minimum diameter location 310 is at a position $Z_1'$ which may be the same as $Z_1$. In the exemplary implementation, an ejector outlet diameter at the outlet 44 is the same in the ejector 300 as in the ejector 200. This outlet diameter may be associated with the size of piping used. FIG. 6 further shows the outlet of the ejector 300 at position $Z_3'$. In the exemplary implementation, $Z_3'$ is shown as the same as $Z_3$. FIG. 6 further shows a partially arbitrarily chosen transition location 312 between the mixer and diffuser at a position $Z_2'$. The exemplary position location 312 is defined as the location wherein a half angle $\theta$ has a value of 1°. The exemplary $Z_2'$ is shown as being essentially the same as $Z_2$.

The ejectors and associated vapor compression systems may be fabricated from conventional materials and components using conventional techniques appropriate for the particular intended uses. Control may also be via conventional methods. Although the exemplary ejectors are shown omitting a control needle, such a needle and actuator may, however, be added.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. An ejector (200; 300; 400; 600) comprising:
a primary inlet (40);
a secondary inlet (42);
an outlet (44);
a primary flowpath from the primary inlet to the outlet;
a secondary flowpath from the secondary inlet to the outlet;
a mixer having a convergent section (204) downstream of the secondary inlet;
a diffuser downstream of the mixer; and
a motive nozzle (100) surrounding the primary flowpath upstream of a junction with the secondary flowpath and having an exit (110),
wherein:
the mixer comprises a downstream divergent section (206) downstream of the convergent section and having a divergence half angle ($\theta_2$) of 0.1-2.0° over a first span of at least 3.0 times a minimum diameter ($D_{MIN}$) of the mixer; and
the diffuser has a divergence half angle of greater than 2.0° over a second span of at least 3.0 times the minimum diameter of the mixer.

2. The ejector (200; 300; 400; 600) of claim 1 wherein:
the downstream divergent section divergence half angle is 0.5-1.5° over said first span.

3. The ejector (200; 300; 400; 600) of claim 2 wherein:
there is no mixer straight portion of more than 5.0 times the minimum diameter of the mixer.

4. The ejector (200; 300; 400; 600) of claim 1 wherein:
the downstream divergent section divergence half angle is 0.8-1.0° over said first span.

5. The ejector (200; 300; 400; 600) of claim 4 wherein:
there is no mixer straight portion of more than 5.0 times the minimum diameter of the mixer.

6. The ejector (200; 300; 400; 600) of claim 1 wherein:
there is no mixer straight portion of more than 5.0 times the minimum diameter of the mixer.

7. The ejector (200; 300; 400; 600) of claim 1 wherein:
a boundary between the downstream divergent section and the diffuser is a distance downstream of the motive nozzle exit 3-6 times the minimum diameter of the mixer.

8. The ejector (200; 300; 400; 600) of claim 7 wherein:
the downstream divergent section divergence half angle and the diffuser divergence half angle continuously progressively increase over said first span and second span.

9. The ejector (200; 300; 400; 600) of claim 7 wherein:
there is no mixer straight portion of more than 5.0 times the minimum diameter of the mixer.

10. The ejector (200; 300; 400; 600) of claim 1 wherein:
the downstream divergent section divergence half angle and the diffuser divergence half angle continuously progressively increase over said first span and second span.

11. The ejector (200; 300; 400; 600) of claim 1 wherein:
the motive nozzle is a convergent-divergent nozzle having said exit within the mixer convergent portion.

12. The ejector (200; 300; 400; 600) of claim 11 wherein:
there is no mixer straight portion of more than 5.0 times the minimum diameter of the mixer.

13. A vapor compression system comprising:
a compressor (22);
a heat rejection heat exchanger (30) coupled to the compressor to receive refrigerant compressed by the compressor;
the ejector (200; 300; 400; 600) of claim 1;
a heat absorption heat exchanger (64); and
a separator (48) having:
an inlet (50) coupled to the outlet of the ejector to receive refrigerant from the ejector;
a gas outlet (54); and
a liquid outlet (52).

14. A method for operating the system of claim 13 comprising:
compressing the refrigerant in the compressor;
rejecting heat from the compressed refrigerant in the heat rejection heat exchanger;
passing a flow of the refrigerant through the primary ejector inlet; and
passing a secondary flow of the refrigerant through the secondary inlet to merge with the primary flow.

15. The method of claim 14 wherein:
the refrigerant comprises at least 50% $CO_2$ by weight.

16. An ejector comprising:
a primary inlet (40);
a secondary inlet (42);
an outlet (44);
a primary flowpath from the primary inlet to the outlet;
a secondary flowpath from the secondary inlet to the outlet;
a convergent section (114) downstream of the secondary inlet;
a motive nozzle (222) surrounding the primary flowpath upstream of a junction with the secondary flowpath and having:
a throat (106); and
an exit (110); and
means for limiting efficiency sensitivity to off-design operating conditions by preventing a shock in a diffuser, wherein:
the means comprises a diverging mixing section; and
the diverging mixing section comprises a zone having a divergence half angle of 0.1-2.0° over a first span of at least 3.0 times a minimum diameter ($D_{MIN}$) of the mixing section.

17. The ejector of claim 13 wherein:
the diverging mixing section does not have a straight portion more than 5.0 times the minimum diameter of the mixing section.

18. The ejector of claim 17 wherein:
a diffuser, downstream of the mixing section, has a divergence angle of greater than 2.0° over a span of at least 3.0 times the minimum diameter of the mixing section.

* * * * *